US009123482B2

(12) United States Patent
Spies

(10) Patent No.: US 9,123,482 B2
(45) Date of Patent: Sep. 1, 2015

(54) CONTACT SLIDE UNIT FOR A SWITCHING UNIT

(75) Inventor: Alexander Spies, Erlangen (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 14 days.

(21) Appl. No.: 14/127,032

(22) PCT Filed: Jun. 20, 2012

(86) PCT No.: PCT/EP2012/061862

§ 371 (c)(1),
(2), (4) Date: Dec. 17, 2013

(87) PCT Pub. No.: WO2013/004499

PCT Pub. Date: Jan. 10, 2013

(65) Prior Publication Data

US 2014/0116862 A1 May 1, 2014

(30) Foreign Application Priority Data

Jul. 5, 2011 (DE) ..... 10 2011 078 632

(51) Int. Cl.

| | |
|---|---|
| ***H01H 1/36*** | (2006.01) |
| ***H01H 15/04*** | (2006.01) |
| ***H01H 50/54*** | (2006.01) |
| *H01H 1/20* | (2006.01) |

(52) U.S. Cl.

CPC ..... *H01H 15/04* (2013.01); *H01H 1/2008* (2013.01); *H01H 50/546* (2013.01); *H01H 1/20* (2013.01)

(58) Field of Classification Search

CPC ..... H01H 1/20; H01H 1/385; H01H 73/045; H01H 33/91; H01H 3/3042; H01H 2003/266; H01H 73/04; H01H 83/20; H01H 50/14; H01H 9/346; H01H 15/04; H01H 33/20; H01H 9/362; H01H 50/546; H01H 1/2008

USPC ..... 200/252

See application file for complete search history.

(56) References Cited

U.S. PATENT DOCUMENTS

| | | | | |
|---|---|---|---|---|
| 5,324,902 | A * | 6/1994 | Shen | 200/517 |
| 5,670,759 | A | 9/1997 | Hsu | |
| 6,242,705 | B1 * | 6/2001 | Huang | 200/520 |

(Continued)

FOREIGN PATENT DOCUMENTS

| | | | |
|---|---|---|---|
| CN | 1886816 | A | 12/2006 |
| DE | 1889859 | U | 3/1964 |

(Continued)

OTHER PUBLICATIONS

Korean Office Action dated Feb. 17, 2015 for corresponding KR Application No. 10-2014-7002934.

(Continued)

*Primary Examiner* — Kyung Lee

(74) *Attorney, Agent, or Firm* — Harness, Dickey & Pierce, P.L.C.

(57) ABSTRACT

A contact slide unit is disclosed for a switching unit, in particular for a circuit breaker, having a contact slide, in which a switching piece can be guided, and a contact slide guide apparatus, in which the contact slide is guided. In at least one embodiment, a linear contact is provided between the contact slide and the contact slide guide apparatus.

11 Claims, 1 Drawing Sheet

(56) References Cited

U.S. PATENT DOCUMENTS

| | | | | |
|---|---|---|---|---|
| 6,556,110 | B1 * | 4/2003 | Niebler et al. | 335/133 |
| 7,285,742 | B2 * | 10/2007 | Kinzler et al. | 218/34 |
| 7,748,105 | B2 * | 7/2010 | Kinzler et al. | 29/622 |
| 2007/0187365 | A1 | 8/2007 | Kinzler | |

FOREIGN PATENT DOCUMENTS

| | | | |
|---|---|---|---|
| DE | 1170497 | B | 5/1964 |
| DE | 1765920 | A1 | 10/1971 |
| DE | 10356271 | A1 | 6/2005 |
| DE | 102007015794 | A1 | 10/2008 |
| EP | 2256766 | A1 | 12/2010 |
| FR | 2202354 | A1 | 5/1974 |
| GB | 1397212 | A | 6/1975 |

OTHER PUBLICATIONS

International Search Report PCT/ISA/210 for PCT/EP2012/061862 dated Oct. 8, 2012.
Written Opinion PCT/ISA/237 for PCT/EP2012/061862 dated Oct. 8, 2012.
German Search Report for German priority patent publication No. DE 10 2011 078 632.5 dated Sep. 20, 2011.
Office Action for Chinese Patent Application No. 201280032947.X dated Apr. 28, 2015 with English translation thereof.

* cited by examiner

CONTACT SLIDE UNIT FOR A SWITCHING UNIT

PRIORITY STATEMENT

This application is the national phase under 35 U.S.C. §371 of PCT International Application No. PCT/EP2012/061862 which has an International filing date of Jun. 20, 2012, which designated the United States of America and which claims priority to German patent application number DE 10 2011 078 632.5 filed Jul. 5, 2011, the entire contents of each of which are hereby incorporated herein by reference.

FIELD

At least one embodiment of the invention generally relates to a contact slide unit for a switching unit, in particular for a circuit breaker, comprising a contact slide in which a switching piece can be guided, and to a contact slide guide device in which the contact slide is guided.

BACKGROUND

Switching units, in particular circuit breakers, are used inter alia for switching off the power supply in a reliable and safe manner in the event of a short circuit and as a consequence said switching units protect consumers and installations. Moreover, electric or mechanical switching units are suitable for manually switching consumers depending upon the operation involved and also for safely and reliably separating an installation from the power supply network when performing maintenance work or making changes to the installation. Electric switching units in particular circuit breakers are frequently operated in an electromagnetic manner.

In other words, switching units of this type are technically complex electric switching devices having integrated protection for motors, lines, transformers and generators. They are used in applications where switching frequency is at a minimum. In addition to providing short circuit protection, switching units of this type are also suitable for providing overload protection.

In the event of a short circuit, an electric switching unit switches an electric installation off in a safe and reliable manner. Consequently, said electric switching units provide a cut-off protection in the event of an overload. The temperature in each conductor through which current flows increases at different rates. The rate of the temperature increase depends upon the ratio of the current magnitude with respect to the conductor cross section, the so-called current density. The current density must not be too high as otherwise owing to the excessively high temperature the conductor insulation can melt and a fire can possibly result. In order to protect electric installations against the damaging effects, switching units are used as overload protection devices.

Circuit breakers comprise two actuating mechanisms that function separately from one another in order to provide the overload protection and short circuit protection. The two actuating mechanisms are connected in series. One electromagnetic actuating mechanism that functions in an almost non-delayed manner with respect to time provides the short circuit protection. In the event of a short circuit, the electromagnetic actuating mechanism releases without delay a switching lock of the circuit breaker. A switching armature separates the switching piece before the short circuit current can achieve its maximum value.

Known switching units comprise a contact slide unit having a contact slide and a movable switching piece. The movable switching piece comprises further electrical contacts. Moreover, switching units of this type comprise fixed contacts to a current line. In a switched-in state, the electrical contacts of the movable switching piece contact the fixed contacts of the switching unit. In the event of a short circuit, the electrical contacts of the movable switching piece are released from the fixed contacts so that the current flow is interrupted. The movable switching piece is released from the fixed contacts.

Known contact slides of switching units frequently comprise two guide systems, an inner guide system and an outer guide system. The outer guide system is then used if the switching procedure, in other words the connecting procedure or the disconnecting procedure is performed by way of a breaker latching mechanism of the switching unit. The inner guide system is used in the event of a short circuit if the switching procedure is performed by way of a switching armature, frequently by way of a push rod of the switching unit. In other words, during a disconnecting procedure as a result of a short circuit, the movable switching piece moves rapidly along the inner guide system ahead of the contact slide, said movable switching piece impacts against the contact surfaces in the so-called lower part of the switching unit and rapidly returns along the inner guide system. Said movable switching piece moves rapidly against the switching armature or rather the push rod of the switching unit.

SUMMARY

The inventor has recognized that a significant problem of known circuit breakers resides in the fact that the contact slide can jam in its guide; this applies in particular where there is a large accumulation of dirt. Silver droplets of different sizes are deposited between the contact slide and the contact slide guide device and can thus cause the contact slide to jam. As a consequence, contacting errors occur since the contact bridge is no longer pressed against the fixed contacts. The contact slide blocks the movement of the bridge. It is thus not possible for the circuit breaker to be returned to its connecting position. The function of the circuit breaker is no longer guaranteed. It must be replaced.

It has hitherto not been possible to solve this problem in a satisfactory manner. Although it is possible to improve the friction relationships between the contact slide and the contact slide guide device by providing a corresponding coating such as for example Teflon, this is however associated with a complex method that is encumbered with disadvantages for the production, in particular as a result of Teflon dust being released. It is therefore desirable to achieve a solution that does not use a coating.

At least one embodiment of the present invention is provides a contact slide unit for a switching unit that can be achieved in a technically simple manner without having to use a complex method and that renders it possible to utilize the switching unit in a reliable manner.

At least one embodiment is directed to a contact slide. Advantageous embodiments and developments that can be used individually or in combination with one another are the subject matter of the dependent claims.

At least one embodiment of the invention is directed to a contact rail unit for a switching unit, in particular for a circuit breaker, comprising a contact slide in which a switching piece can be guided, and a contact slide guide device in which the contact slide is guided. In at least one embodiment of the invention, a linear contact is provided between the contact slide and the contact slide guide device.

BRIEF DESCRIPTION OF THE DRAWINGS

Further advantages and embodiments of the invention are explained hereinunder with reference to example embodiments and also with reference to the drawing, which illustrates schematically.

DETAILED DESCRIPTION OF THE EXAMPLE EMBODIMENTS

Figure 1:
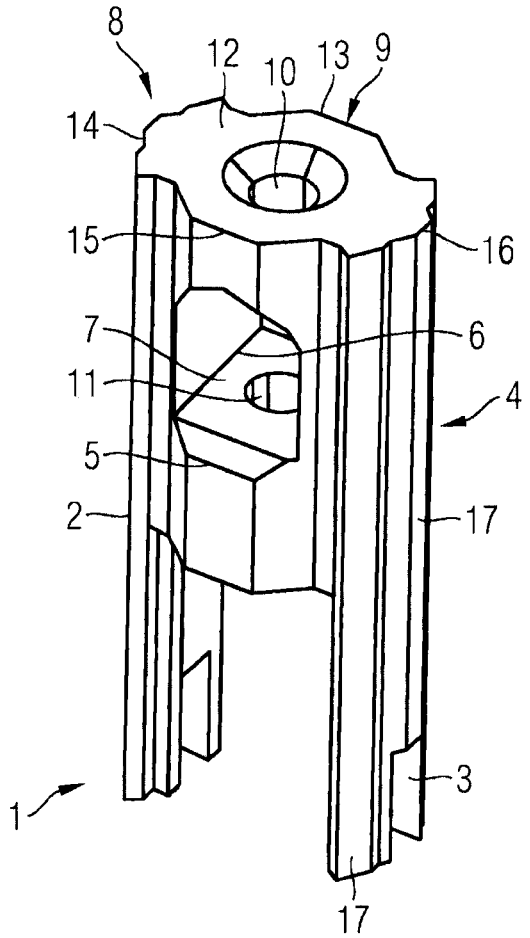
in FIG. 1 a perspective view of a contact slide in accordance with an embodiment of the invention with a linear guide arrangement; and in FIG. 2 a plan view of an example embodiment of a contact slide in accordance with the invention that is installed in a switching housing.

At least one embodiment of the invention is directed to a contact rail unit for a switching unit, in particular for a circuit breaker, comprising a contact slide in which a switching piece can be guided, and a contact slide guide device in which the contact slide is guided. In at least one embodiment of the invention, a linear contact is provided between the contact slide and the contact slide guide device.

An essential feature of at least one embodiment of the present invention resides in the fact that the contact slide and the contact slide guide device are in linear contact with one another and intermediate spaces are intentionally provided. Previous slide contours are designed in such a manner that surface contact is provided. As a consequence, there is a risk that large silver droplets can cause jamming. In the case of the linear contact in accordance with the invention, the probability of a silver droplet jamming precisely on the linear guide arrangement is reduced. The spaces between the individual guide lines that can be embodied in the form of webs provide space for the droplets to be deposited.

The contact slide in accordance with at least one embodiment of the invention preferably comprises two parallel aligned limb elements that are connected to one another in the upper region of the contact slide by way of at least a first transition region. The limb elements are used to guide a contact pressure spring, not illustrated. A cut-out is formed above the transition region; and by way of such a cut-out, a contact surface of the transition region is revealed. A switching piece, not illustrated, can be placed on this contact surface. A second transition region is preferably formed on the upper end of the limb element and said second transition region connects the two limb elements to one another. The first transition region is formed parallel to the second transition region. The two transition regions preferably comprise centrally arranged concentric cut-outs that are designed so as to guide through a switching armature, in particular a push rod. The contact slide comprises in its second transition region a surface that comprises four lateral edges, wherein the respective opposite lying lateral edges are embodied in an identical manner. The first pair of opposite lying lateral edges is preferably embodied in a part concentric manner, wherein preferably linear-shaped lugs are formed on the part concentric lateral edges along the limb elements. The second pair of opposite lying lateral edges is preferably embodied as a polygon.

The contact slide in accordance with at least one embodiment of the invention is embedded in the housing of the switching device, in particular of a circuit breaker, in such a manner that as far as possible a low contact guiding arrangement is provided. The large part of the region between the contact slide and the switching chamber is therefore generously cut-out in order to provide space for the silver droplets. A point-contact guiding arrangement is only provided at in total preferably six points, namely at points where the linear-shaped lugs are formed. At least one linear-shaped cut-out is arranged in each case adjacent to a linear-shaped lug, said linear-shaped cut-out being preferably likewise arranged parallel to said linear-shaped lug, so that an alternating arrangement of linear-shaped lugs and linear-shaped cut-outs is produced.

At least one embodiment of the present invention is characterized by virtue of the fact that only one linear contact arrangement is provided between a contact slide of a switching device, in particular of a circuit breaker and a contact slide guide device, in other words therefore the housing. An object of the linear guide arrangement is to provide an as far as possible low contact guiding arrangement of the contact slide. In the event of a short circuit, silver droplets are deposited on the walls of the switching chamber and in the case of a surface contact this can lead to the contact slide jamming in the switching chamber. The large part of the region between the contact slide and the switching chamber is therefore generously cut out in order to provide space for the silver droplets. It is preferred that a point-contact guiding arrangement is only provided in the form of linear-shaped lugs at in total six points.

The probability of the slide jamming is reduced by virtue of the linear guide arrangement in accordance with the invention. Space is provided in which the silver droplets can collect. As a consequence, the overall risk of contacting errors of the switching device is reduced.

FIG. 1 illustrates a contact slide 1 in accordance with an embodiment of the invention that preferably comprises two parallel aligned limb elements 2, 3 that are connected to one another in the upper region 4 of the contact slide 1 by way of at least a first transition region 5. The limb elements 2, 3 are used to guide a contact pressure spring that is not illustrated. A cut-out 6 is formed above the transition region 5 by which a contact surface 7 of the transition region 5 is revealed. A switching piece, not illustrated, can be placed on this contact surface 7. A second transition region 9 is preferably formed on the upper end 8 of the limb elements 2, 3 which second transition region connects the two limb elements 2, 3 to one another. The first transition region 5 is formed in parallel to the second transition region 9. The two transition regions 5, 9 preferably comprise centrally arranged concentric cut-outs 10, 11 and are designed so as to guide through a switching armature, in particular a push rod.

The contact slide 1 comprises in its transition region 9 a surface 12 that comprises four lateral edges 13, 14, 15, 16, wherein the respective opposite lying lateral edges 13, 15 and 14, 16 are embodied in an identical manner. The lateral edges 14, 16 are preferably embodied in a part concentric manner, wherein linear-shaped lugs 17 are formed on the part concentric lateral edges 14, 16 along the limb elements 2, 3. The opposite lying lateral edges 13, 15 are preferably embodied as a polygon. At least one linear-shaped cut-out 18 is arranged in each case adjacent to a linear-shaped lug 17, said linear-shaped cut-out being preferably likewise arranged parallel to said linear-shaped lug, so that an alternating arrangement of linear-shaped lugs 17 and linear-shaped cut-outs 18 is produced.

Figure 2:
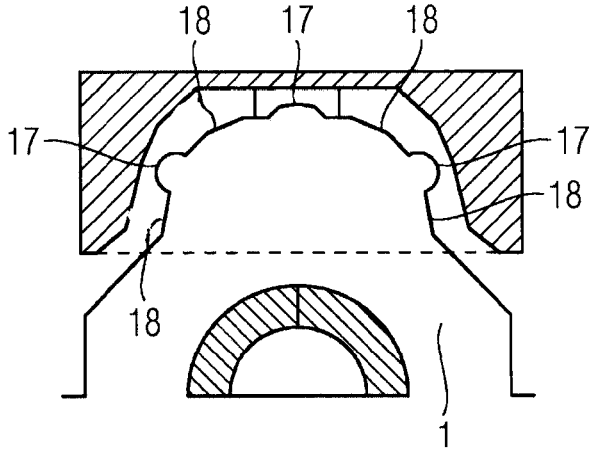

FIG. 2 illustrates the contact slide 1 in accordance with an embodiment of the invention in its switching housing environment. The contact slide 1 in accordance with the invention is embedded in the housing of the switching device, in particular a circuit breaker, in such a manner that as far as possible a low contact guide arrangement is provided. The silver droplets that in the event of a short circuit are deposited on the walls of the switching chamber cause the contact slide to jam in the switching chamber in the case of a surface contact. In accordance with an embodiment of the invention, the large part of the region between the contact slide 1 and the switching chamber is therefore generously cut out in order to provide space for the silver droplets to collect. A point-contact guiding arrangement is only provided in the form of linear-shaped lugs 17 at in total preferably six points.

An embodiment of the present invention is characterized by virtue of the fact that only one linear contact arrangement is provided between a contact slide of a switching device, in particular of a circuit breaker and a contact slide guide device, in other words therefore the housing. The object of the linear guide arrangement is to provide an as far as possible low contact guiding arrangement of the contact slide. In the event of a short circuit, silver droplets are deposited on the walls of the switching chamber and in the case of a surface contact this can lead to the contact slide jamming in the switching chamber. The large part of the region between the contact slide and the switching chamber is therefore generously cut out in order to provide space for the silver droplets. It is preferred that a point-contact guiding arrangement is only provided in the form of linear-shaped lugs at in total six points. The probability of the slide jamming is reduced by virtue of the linear guide arrangement in accordance with the invention. Space is provided for the silver droplets to collect. As a consequence, the overall risk of contacting errors of the switching device is reduced.

The invention claimed is:

1. A contact slide unit for a switching unit, comprising:

a contact slide in which a switching piece is guidable;

a contact slide guide device in which the contact slide is guidable; and a linear guide arrangement, provided between the contact slide and the contact slide guide device, wherein the contact slide comprises two parallel aligned limb elements, connected to one another in an upper region by a first transition region, each of the two parallel aligned limb elements including a pair of parallel linear-shaped lugs extending therefrom along the entire length of each limb element and forming a cut-out therebetween.

2. The contact slide unit of claim 1, wherein the contact slide comprises a second transition region, the second transition region including a surface that comprises four lateral edges, wherein respective opposite lying ones of the four lateral edges are embodied in an identical manner.

3. The contact slide unit of claim 2, wherein the opposite lying lateral edges are embodied as a polygon.

4. The contact slide unit of claim 2, wherein respective opposite lying side edges are embodied in a concentric manner, wherein the linear-shaped lugs are arranged on the concentric lateral edges.

5. The contact slide unit of claim 1, wherein the linear guide arrangement is produced in the form of an alternating arrangement of the linear-shaped lugs and the cut-outs.

6. The contact slide unit of claim 1, wherein the contact slide unit is for a circuit breaker.

7. A switching unit comprising the contact slide unit of claim 1.

8. A circuit breaker comprising the contact slide unit of claim 1.

9. The contact slide unit of claim 1, wherein the contact slide comprises a transition region, the transition region including a surface that comprises four lateral edges, wherein respective opposite lying ones of the four lateral edges are embodied in an identical manner.

10. The contact slide unit of claim 9, wherein the opposite lying lateral edges are embodied as a polygon.

11. The contact slide unit of claim 9, wherein respective opposite lying side edges are embodied in a concentric manner, wherein the linear-shaped lugs are arranged on the concentric lateral edges.

* * * * *